US009782617B2

(12) United States Patent
Ferguson, Jr.

(10) Patent No.: US 9,782,617 B2
(45) **Date of Patent: *Oct. 10, 2017**

(54) PIRI-STRETCHER SYSTEM

(71) Applicant: Thomas Alan Ferguson, Jr., San Francisco, CA (US)

(72) Inventor: Thomas Alan Ferguson, Jr., San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/821,728

(22) Filed: Aug. 8, 2015

(65) Prior Publication Data

US 2015/0343251 A1 Dec. 3, 2015

Related U.S. Application Data

(63) Continuation-in-part of application No. 13/563,291, filed on Jul. 31, 2012, now Pat. No. 9,101,794, which is a continuation-in-part of application No. 12/885,511, filed on Sep. 19, 2010, now abandoned.

(51) Int. Cl.
*A63B 21/00* (2006.01)
*A61H 1/02* (2006.01)

(52) U.S. Cl.
CPC ..... *A63B 21/00185* (2013.01); *A61H 1/02* (2013.01); *A61H 1/0255* (2013.01); *A61H 2201/1269* (2013.01); *A61H 2201/1276* (2013.01); *A61H 2201/164* (2013.01); *A61H 2201/165* (2013.01); *A61H 2203/045* (2013.01); *A61H 2203/0456* (2013.01)

(58) Field of Classification Search
CPC ..... A63B 21/00138; A63B 21/00156; A63B 21/00185; A63B 21/002; A63B 21/0023; A63B 21/14; A63B 21/1423; A63B 2023/006; A63B 21/068; A63B 21/4035; A63B 21/4015
USPC ..... 482/51, 91, 92, 121, 122, 124, 126, 131, 482/139, 907; 2/22, 24; 128/882; 602/23, 26, 62
See application file for complete search history.

(56) References Cited

U.S. PATENT DOCUMENTS 3,926,186 A * 12/1975 Nirschl ..... A61F 5/0106 602/62
4,342,185 A * 8/1982 Pellew ..... A01K 13/007 54/82
4,777,946 A * 10/1988 Watanabe ..... A61F 13/062 128/882
5,004,228 A 4/1991 Powers
5,014,692 A 5/1991 Rhoades
5,080,095 A * 1/1992 Tungate ..... A61F 7/103 383/901
5,139,015 A * 8/1992 Morneau ..... A61F 13/062 128/882
5,221,252 A 6/1993 Caprio et al.
5,417,646 A * 5/1995 Gauvry ..... A61F 5/0106 602/26

(Continued)

*Primary Examiner* — Andrew S Lo
(74) *Attorney, Agent, or Firm* — Steven A. Nielsen; www.NielsenPatents.com

(57) ABSTRACT

A system for stretching the piriformis muscle may comprise a thigh strap, calf strap and one or more handles. A handle may be pulled to urge the piriformis muscle into a more elongated position. The thigh strap and calf strap may be of equal or unequal length. An optional knee void may be used for alignment purposes and may be found beneath a handle.

4 Claims, 23 Drawing Sheets

(56) References Cited

U.S. PATENT DOCUMENTS 5,490,826 A 2/1996 Rose
5,634,873 A 6/1997 Carlstrom
5,656,023 A 8/1997 Caprio et al.
5,779,655 A 7/1998 Holden
6,080,124 A * 6/2000 Falk ..... A61F 5/34 602/23
6,315,748 B1 11/2001 Morgan, Jr.
6,338,700 B1 1/2002 Pollock
6,402,712 B1 * 6/2002 Gauvry ..... A61F 13/062 602/26
6,422,981 B1 7/2002 Riser
6,610,023 B2 8/2003 Steponovich
6,641,549 B2 * 11/2003 Darcey ..... A61F 13/062 602/23
7,329,214 B1 2/2008 Norman
7,335,167 B1 2/2008 Mummy
7,438,921 B2 10/2008 First
7,662,122 B2 * 2/2010 Sterling ..... A61F 5/0123 128/882
8,187,212 B2 * 5/2012 Shmidman ..... A61F 5/0104 128/882
8,926,539 B2 * 1/2015 Cropper ..... A61F 5/0123 602/23
9,101,794 B2 * 8/2015 Ferguson, Jr. ... A63B 21/00185
2005/0192168 A1 * 9/2005 Wilcocks ..... A63B 21/0004 482/124
2006/0135901 A1 * 6/2006 Ingimundarson ..... A61F 5/0123 602/26
2006/0211967 A1 * 9/2006 Reynolds ..... A61F 5/0102 602/23
2008/0039303 A1 * 2/2008 Wilcocks ..... A63B 21/0552 482/124
2008/0171065 A1 7/2008 O'Brien
2008/0183171 A1 7/2008 Elghazaly et al.
2009/0099562 A1 * 4/2009 Ingimudarson ..... A61F 5/0123 606/36
2009/0239723 A1 9/2009 Jovanovic
2009/0291807 A1 11/2009 Moring, Jr. et al.
2010/0094189 A1 * 4/2010 Ingimundarson ..... A61F 5/0123 602/26

* cited by examiner

PIRI-STRETCHER SYSTEM

RELATED PATENT APPLICATION AND INCORPORATION BY REFERENCE

This is utility application is a continuation in part of pending U.S. patent application Ser. No. 13/563,291 filed on Jul. 31, 2012 which is a continuation in part of patent application Ser. No. 12/885,511 filed on Sep. 19, 2010. This related application is incorporated herein by reference and made a part of this application. If any conflict arises between the disclosure of the invention in this utility application and that in the related application, the disclosure in this utility application shall govern. Moreover, the inventor incorporates herein by reference any and all patents, patent applications, and other documents hard copy or electronic, cited or referred to in this application and the related application.

COPYRIGHT AND TRADEMARK NOTICE

This application includes material which is subject or may be subject to copyright and/or trademark protection. The copyright and trademark owner has no objection to the facsimile reproduction by any of the patent disclosure, as it appears in the Patent and Trademark Office files or records, but otherwise reserves all copyright and trademark rights whatsoever. No trademark rights to the term "Piri-Stretcher" or any other term are waived herein.

BACKGROUND OF THE INVENTION (1) Field of the Invention

The invention generally relates to devices enabling stretches. More particularly, the invention relates to means and methods of stretching the elusive piriformis muscle.

(2) Description of the Related Art

The related art is focused upon repair or palliative measures to address the after the fact damage inflicted by a tight piriformis muscle. A tight piriformis muscle is known to cause Piriformis Syndrome, sciatic nerve impingement and other serious ailments.

U.S. Pat. No. 5,221,252 issued on Jun. 22, 1993 to Caprio et al discloses an adjustable knee support but has a design that prohibits the effective attachment of handles. Capro's '252 Patent has a center strap that reached behind the knee and prevents bent knee stretching or other types of positions needed to stretch the piriformis muscle.

U.S. Pat. No. 5,656,023 issued on Aug. 12, 1997 to Caprio et al is an elaboration of Capro's '252 Patent and adds tabs and additional fasteners that impede knee movement. The Caprio '023 Patent presents several layers of wrapping above and below the knee area, preventing the addition or attachment of stretching straps or handles.

U.S. Pat. No. 5,779,655 issued on Jul. 14, 1998 to Holden discloses two leg straps, a longitudinal member and one or two loop handles. Holden fails to disclose or suggest a leg strap above the knee area. Holden is designed for use with a leg cast and is not a stretching device.

U.S. Pat. No. 7,329,214 issued on Feb. 12, 2008 to Norman discloses a stomach exercising strap comprising a single leg loop and parallel handle strap. Norman enables a rocking motion useful for abdominal development but counterproductive for piriformis stretching.

U.S. Patent Publication 20090239723 by Jovanovic published on Sep. 24, 2009 discloses a foot handle or foot harness system attached to a foot and ankle. Jovanovic fails to provide means of pulling upon the knee or thigh area.

U.S. Patent

U.S. Patent Publication 2008/0183171 by Elghazaly et al published on Jul. 31, 2008 discloses orthopedic hardware that is screwed into a femur as part of a reconstruction piriformis fixation procedure. The disclosed hardware and method includes the use of piriformis lag screws that pass through a piriformis implant. While the Elghazaly disclosure is focused upon repairing a broken femur due to trauma, the Elghazaly disclosure emphasizes the importance of carefully positioning and carefully considering the piriformis muscle.

U.S. Pat. No. 7,335,167 by Mummy issued on Feb. 26, 2008 discloses a software system and apparatus to measure deviations of posture caused by various ailments and issues recommendations such as generic piriformis stretches. The Mummy reference provides no means or methods of stretching the piriformis muscle.

U.S. Patent Publication 2009/0291807 by Moring, J R. et al published on Nov. 26, 2009 discloses an exercise platform stood upon by those inflicted with Piriformis Syndrome. The Morng platform is not invasive but fails to isolate the piriformis muscle or otherwise stretch the piriformis muscle.

U.S. Patent Publication 2009/0286661 by Campbell discloses a foot trap and strap system used to facilitate leg and stride stretching. But, Campbell does nothing to enable bent knee stretches and fails to consider the need to isolate stretches for the piriformis muscle.

U.S. Pat. No. 8,025,617 by Tennant et al issued on Sep. 27, 2011 discloses a boot and straight leg stretch system to stretch the hamstring muscle. Tennant teaches straight leg raises with no bend in the knees and fails to address the piriformis muscle.

U.S. Pat. No. 6,689,028 by Smith issued on Feb. 10, 2004 discloses a planar non-bending board with a hand strap. The Smith appliance provides planar leg support just below the knee in the calf area to facilitate straight leg raises. Smith teaches away from bent knee stretches and fails to address the piriformis muscle.

U.S. Patent Publication 2003/0224019 by O'Brien published on Dec. 4, 2003 discloses the injection of various toxins to relieve nerve impingement. The O'Brien reference gives an excellent summary of Piriformis Syndrome leading to sciatic pain, stating at paragraph [0024] O'Brien states: "Sciatic pain can be caused by compression of the sciatic nerve by the piriformis muscle. This condition is commonly referred to as sciatica and is quite common in the middle-aged and elderly. The piriformis muscle extends from the pelvic surface of the sacrum to the upper border of the greater trochanter of the femur and, during running or sitting, can squeeze the sciatic nerve at the site where the nerve emerges from under the piriformis to cover the gemellus and obturator internus muscles"

While the O'Brien reference mentions various physical positions to test for Piriformis Syndrome, O'Brien states that stretching exercises are "rarely beneficial" and that forcibly raising the knee often aggravates symptoms. Thus, O'Brien teaches away from stretching exercises to treat Piriformis Syndrome and instead encourages injections of botulinum type B toxin. Given that O'Brien is a recent reference and eschews stretching, there is long felt need in the art for less invasive means of preventing and treating Piriformis Syndrome.

BRIEF SUMMARY OF THE INVENTION

The present invention overcomes shortfalls in the related art by presenting an unobvious and unique combination, configuration and use of physical components to assist a user in stretching the piriformis muscle. Current embodiments of the invention have achieved unexpected results in relieving aliments caused by a tight piriformis muscle. The favorable results of the disclosed embodiments are unobvious in light of the prior art, such as O'Brien teaching specifically away from stretching and teaching the use of pharmaceutical solutions.

The disclosed embodiments are also unobvious in light of the prior art stretching devices. For example, U.S. Pat. No. 5,004,228 by Powers issued on Apr. 2, 1991 discloses a general rope structure used to flex feet in an upward position. The rope of Powers fails to describe or anticipate bent knee stretches and fails to address the piriformis muscle.

Disclosed embodiments facilitate the stretch of the piriformis muscles, giving the user added control, range of motion, comfort and grip. A disclosed embodiment comprises a thigh strap, calf strap and one or more handle straps to secure both the calf and thigh. One or more handles may be centered over the knee area to control the knee area especially when the knee is bent. A disclosed configuration of components allows a user to bend a knee, pull the knee back toward the body and cross the opposite leg over the knee area. An optionally marked area upon the thigh strap gives users a target area to rest the ankle of their opposite leg over the secured knee area. Alternatively, a user may rest the back side of their knee upon their opposite leg over the secured knee area. In general, disclosed embodiments are secured to the leg in general. Disclosed embodiments are not a knee brace but are configured to assist in stretching exercises.

In one embodiment, a disclosed piri-stretcher system is secured around the calf and thigh area such that one or more handles may be centered over the knee. The user lies upon their back and places a foot or ankle over the marked area of the thigh strap. A user grasps a handle of the handle assembly and gently, gradually and smoothly pulls toward their chest for a period of time. In the best mode known to date, the time period is approximately 60 seconds and the stretch is performed three times per side per day.

Disclosed embodiments include calf and thigh straps of equal or unequal lengths. Disclosed embodiments may have knee voids or be devoid of knee voids. Pull systems may have one or more straps and straps may comprise separate handles. Pull straps may be parallel or perpendicular to the thigh and calf straps. The assembly of one more or handles may be centered or uncentered in relation to the thigh and calf straps. The thigh and calf straps may be secured by any means, including the use of Velcro or buckles.

REFERENCE NUMERALS IN THE DRAWINGS

Figure 1:
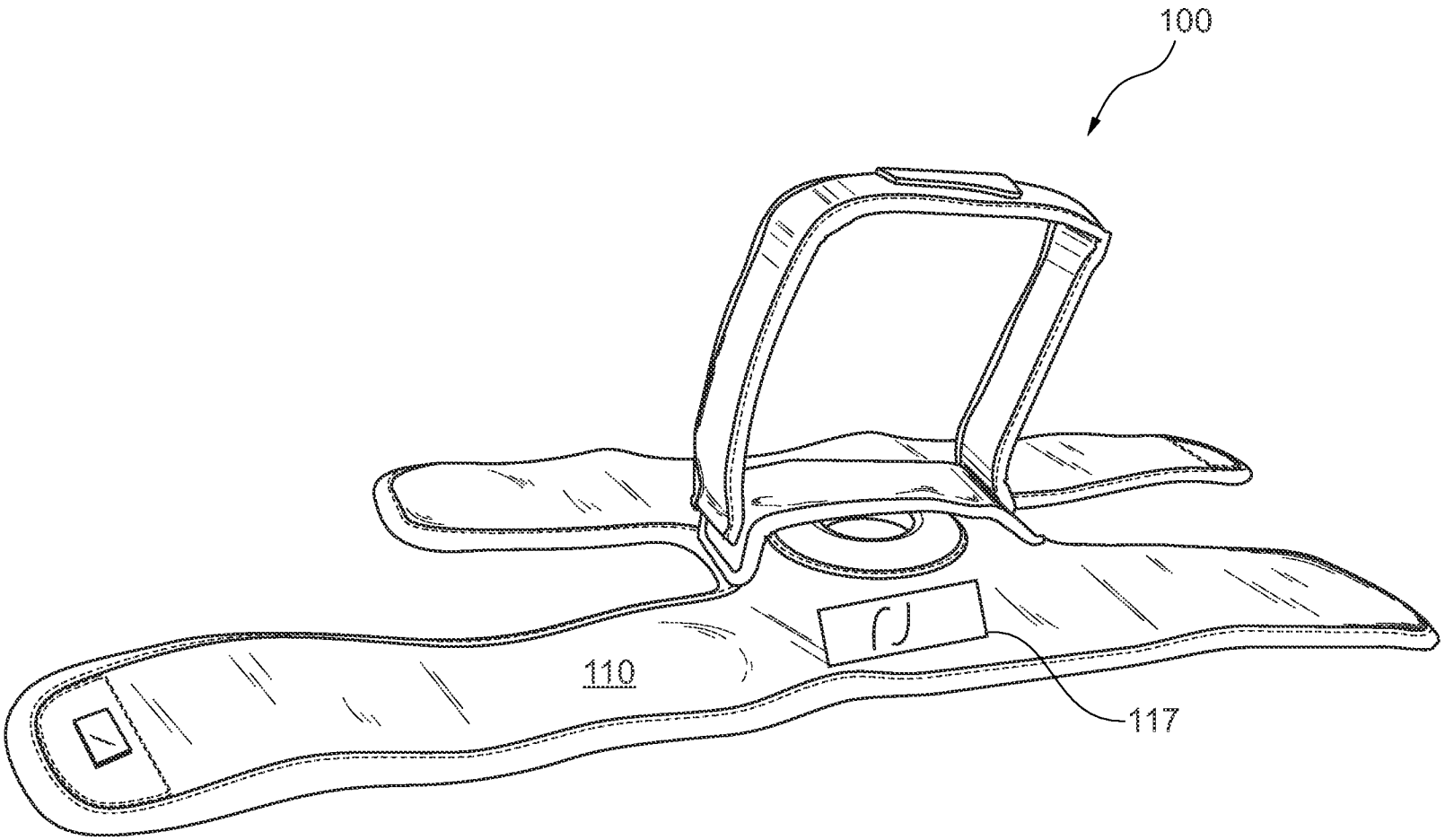
FIG. 1 is a top perspective view of a disclosed piri-stretcher.

100 an embodiment of the invention in general sometimes called a piri-stretcher or Piri-Stretcher®.

110 a thigh strap

111 an upper surface of the thigh strap 110

112 a lower surface of the thigh strap 110

113 a thigh hook section sometimes found upon the lower surface of the thigh strap 110

114 attachment points sometimes securing the thigh hook section 113, the attachment points 114 sometimes seen upon the upper surface of the thigh strap 110

115 a minor section of the thigh strap, sometimes defined as the shorter strap section starting at a center point of the circular collar and ending at the outer end.

116 a major section of the thigh strap, sometimes defined as the longer strap section, as compared to the minor section, starting at a center point of the circular collar and ending at the outer end.

117 placement markings for angle or calf placement

120 a calf strap

121 a upper surface of the calf strap 120

122 a lower surface of the calf strap 120

123 a calf hook section sometimes found upon the lower surface of the calf strap 120

124 attachment points sometimes securing the calf hook section 123, the attachment points sometimes seen upon the upper surface of the calf strap 120

125 a minor section of the calf strap 120, sometimes defined as the shorter section of strap, starting at the midpoint of the circular collar and extending to the outer end of the minor section.

126 a major section of the calf strap 120, sometimes defined as the longer section of strap, starting at the midpoint of the circular collar and extending to the outer end of the major section.

150 a center assembly of a disclosed piri-stretcher

155 a center zone connecting the calf strap 120 to the thigh strap

160 center material attached to the calf strap 120 and thigh strap 110

170 a circular collar found upon the center material 160

171 an upper surface of the circular collar, the upper surface sometimes being convex in relation to the surrounding center material 160

172 a lower surface of the circular collar, the lower surface sometimes being convex or planar in relation to the surrounding center material 160

173 an outer perimeter of the circular collar 170

175 an inner perimeter of the circular collar, the inner perimeter defining a knee cap void

180 a knee cap void, defined by the inner perimeter 175 of the circular collar 170

200 a handle assembly

210 a lower handle sometimes attached to the center material 160

212 a lower surface of the lower handle 210

214 an upper surface of the lower handle 210

215 a handle connection area sometimes connecting the upper handle to the lower handle

220 an upper handle, sometimes attached to the lower handle 210

221 optional logo section upon upper handle 220

222 a lower surface of the upper handle 220

224 an upper surface of the upper handle 220

250 a handle assembly normal or perpendicular to the thigh and calf straps

260 a handle secured by one strap

270 a handle assembly comprising a single handle or single pull strap

300 a buckle system

310 buckle voids defined within calf or thigh straps

400 a human being in general

410 a calf of a human being

430 a right leg of a human being

440 a left leg of a human being

445 ankle area of a human being

446 a thigh of a human being

450 hands of a human being

500 a piriformis muscle

505 a directional arrow pointing to a piriformis muscle

510 a sciatic nerve

515 a directional arrow pointing to a sciatic nerve

These and other aspects of the present invention will become apparent upon reading the following detailed description in conjunction with the associated drawings.

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

All the above references and U.S. patents and applications are incorporated herein by reference. Aspects of the invention can be modified, if necessary, to employ the systems, functions and concepts of the various patents and applications described above to provide yet further embodiments of the invention.

FIG. 1 depicts an embodiment in general 100 having a placement markings 117 upon the thigh strap 110.

Figure 2:
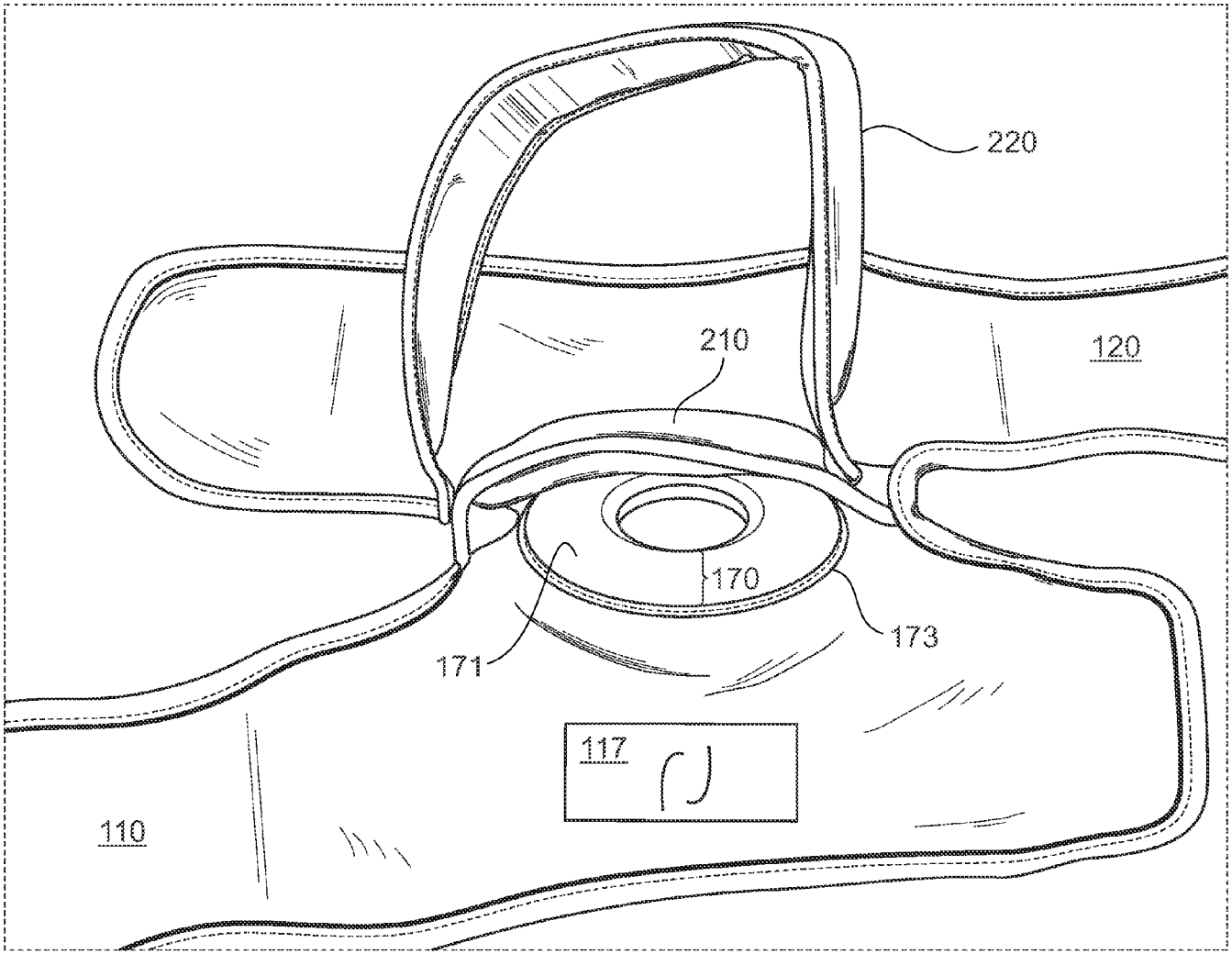
FIG. 2 is an enlarged view from FIG. 1.

FIG. 2 depicts a section of a piri-stretcher and shows a thigh strap 110 having placement markings 117, the placement marking sometimes used as reference marks for a user to place an ankle, foot or knee from the unsecured leg. An upper handle 220 is shown above a lower handle 210, with both handles centered over a circular collar 170. The circular collar 170 having an upper surface 171 and an outer perimeter 173.

Figure 3:
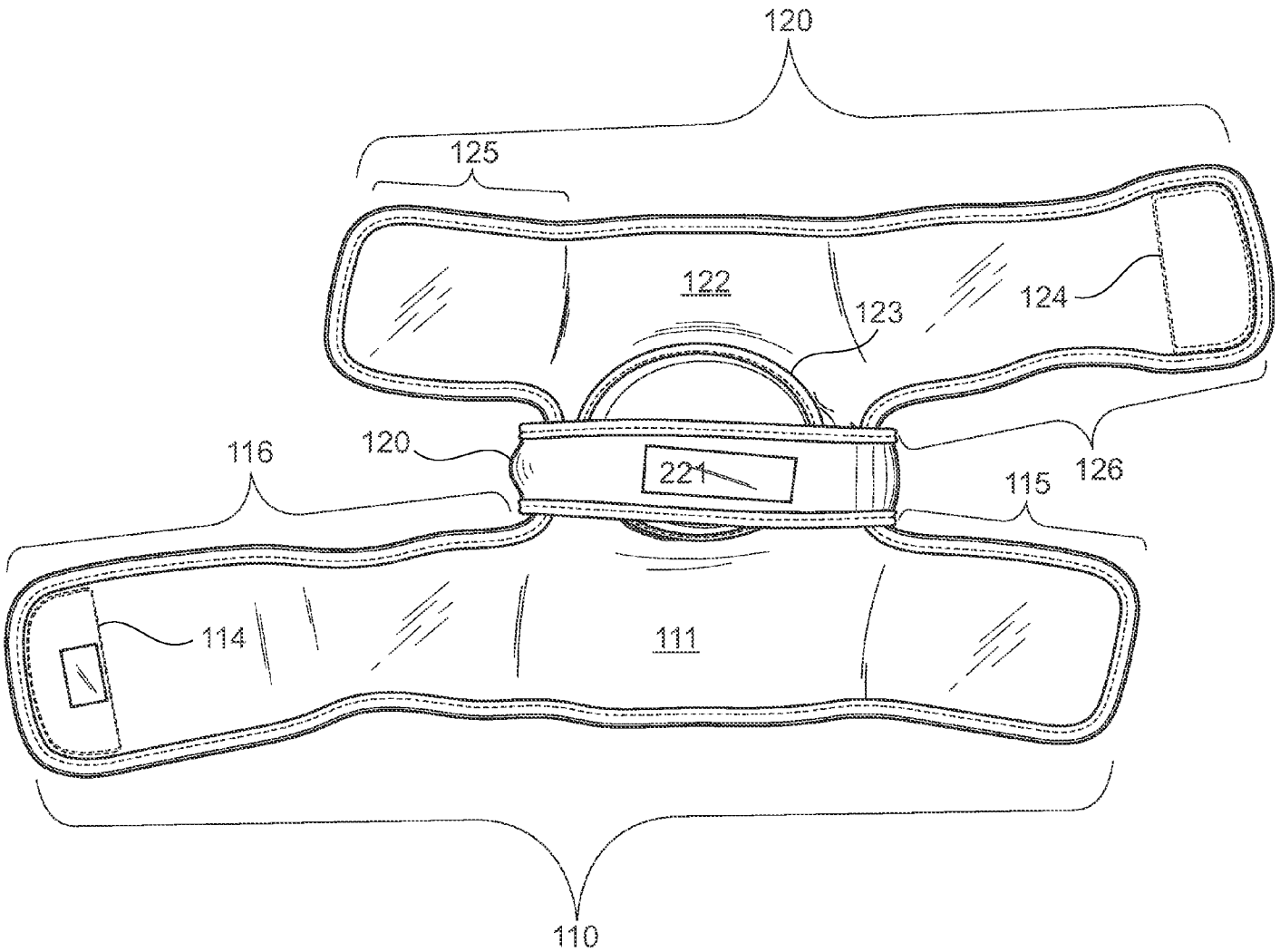
FIG. 3 is a top plan view of a disclosed piri-stretcher.

FIG. 3 depicts a top plan view showing a thigh strap 110 comprising a major section 116 being longer in length as compared to the minor section 115 of the thigh strap. The thigh strap having attachment points 114 or attachment seams sometimes securing a thigh hook section (not shown) found upon the bottom surface of the thigh strap.

FIG. 3 depicts an upper handle 120 having an optional logo area 221. The upper handle 120 is sometimes centered over a circular collar, the circular collar shown with an outer perimeter 173. A calf strap 120 comprises a major section 126 being longer in length as compared to the minor section 125. The major section 126 of the calf strap is shown with attachment points 124 or seams sometimes securing a calf hook section (not shown).

Figure 4:
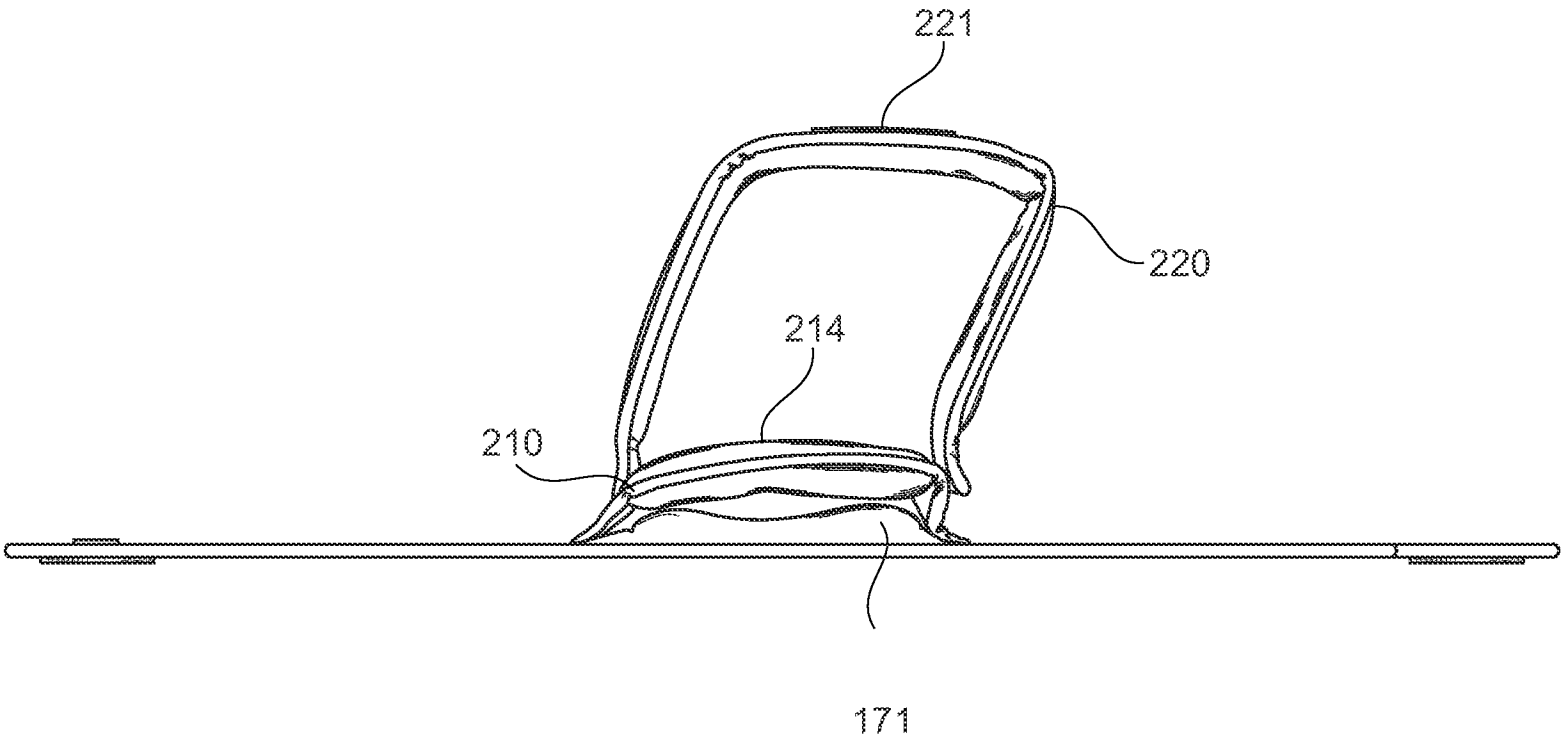
FIG. 4 is a left side view of a disclosed piri-stretcher.

FIG. 4 depicts an upper handle 220, an optional logo section 221 upon the upper or top handle 220. A lower handle 210 is shown with an upper surface 214. An upper surface 171 of a circular collar is shown underneath the lower handle 210.

Figure 5:
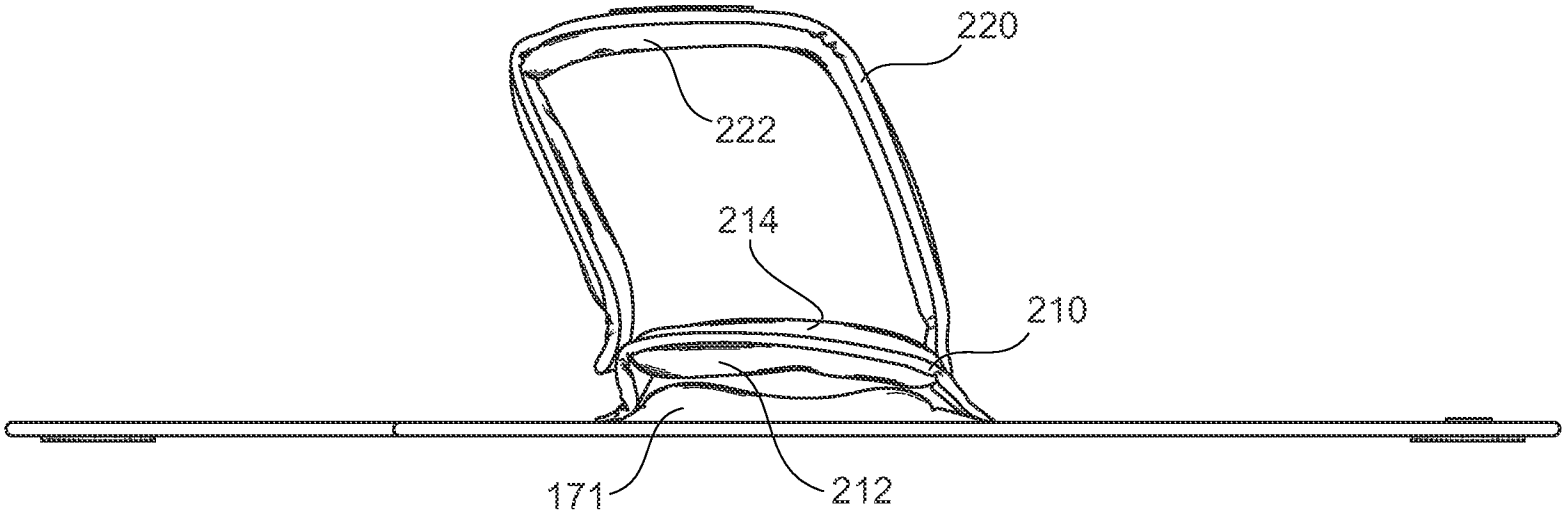
FIG. 5 is a right side view of a disclosed piri-stretcher.

FIG. 5 depicts an upper handle 220 with a lower surface 222. A lower handle 210 is shown with an upper surface 214 and a lower surface 212. Just below the lower handle, an upper surface 171 of the circular collar is shown.

Figure 6:
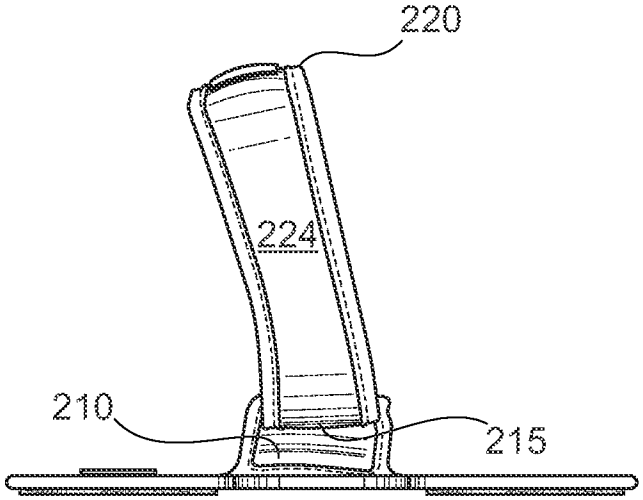
FIG. 6 is a rear side view of a disclosed piri-stretcher.

FIG. 6 depicts an upper handle 220 having an upper surface. A handle connection area 215 is shown and sometimes acts as an area of attachment securing the upper handle 220 to the lower handle 210.

Figure 7:
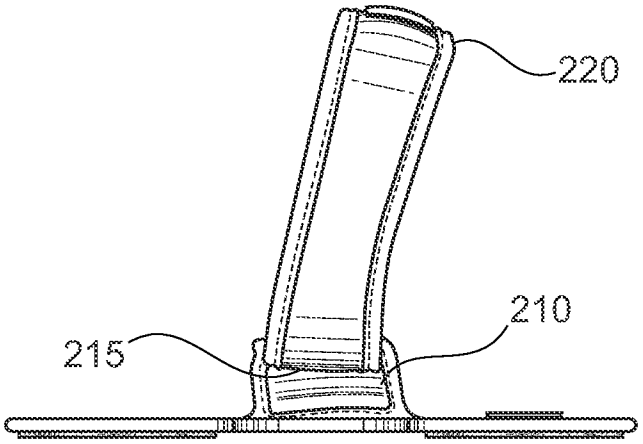
FIG. 7 is a front side view of a disclosed piri-stretcher.

FIG. 7 depicts a handle connection area 215 sometimes securing the upper handle 220 to the lower handle 210.

Figure 8:
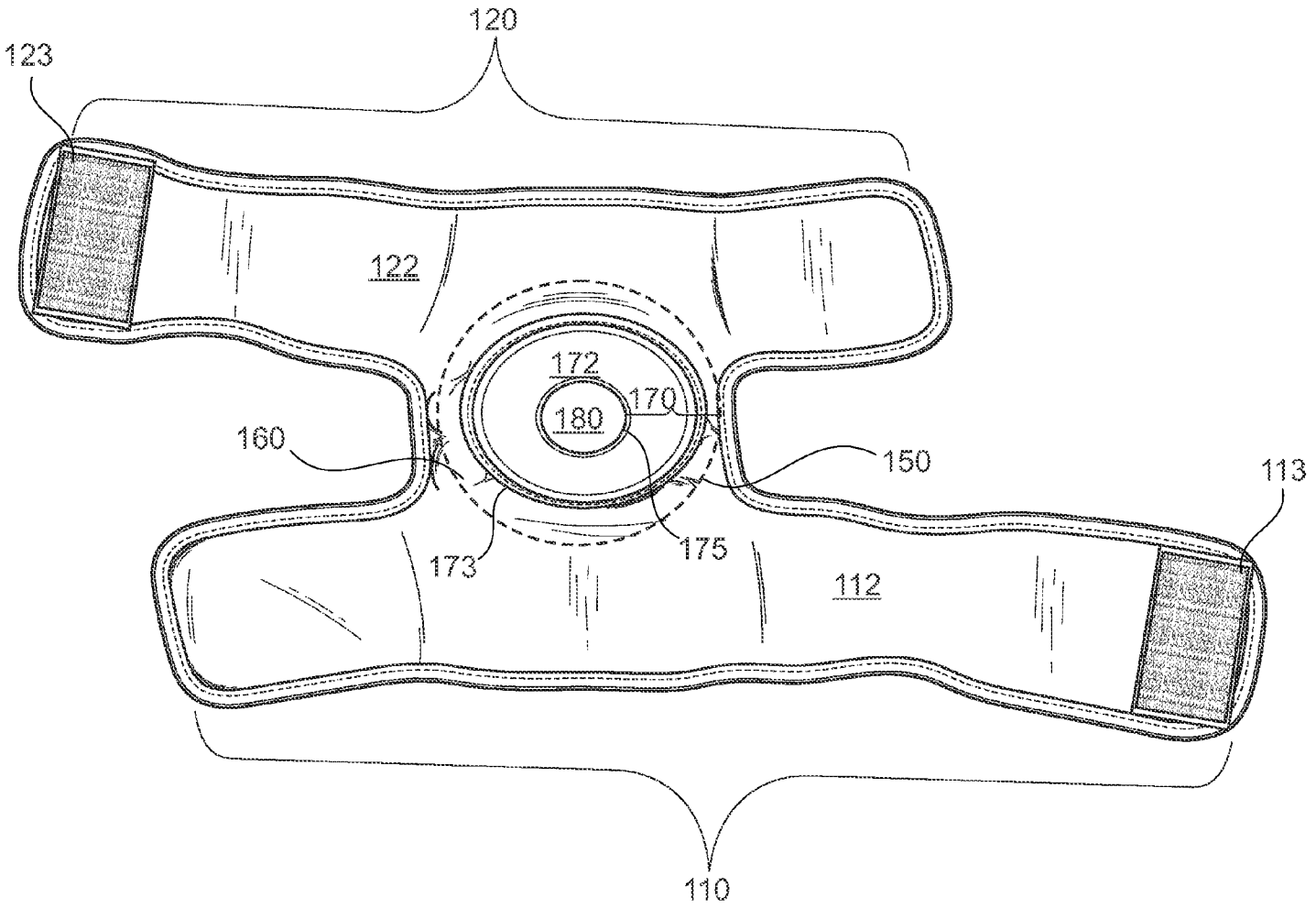
FIG. 8 is a bottom side view of a disclosed piri-stretcher.

FIG. 8 depicts a bottom side of a piri-stretcher having a thigh strap 110 comprising a lower surface 112 and a thigh hook section 113. The calf strap 120 comprises a lower surface and a calf hook section 123.

In FIG. 8, a center assembly 150 is found between the thigh strap 110 and the calf strap 120. The center assembly 150 comprises center material 160, the center material 160 sometimes connecting to both the thigh strap 110 and the calf strap 120.

Within the center material 160 contains a circular collar 170, the circular collar 170 defined by an outer perimeter 173 and an inner perimeter 175. A knee cap void 180 is defined by the inner perimeter 175 of the circular collar 170.

Figure 9:
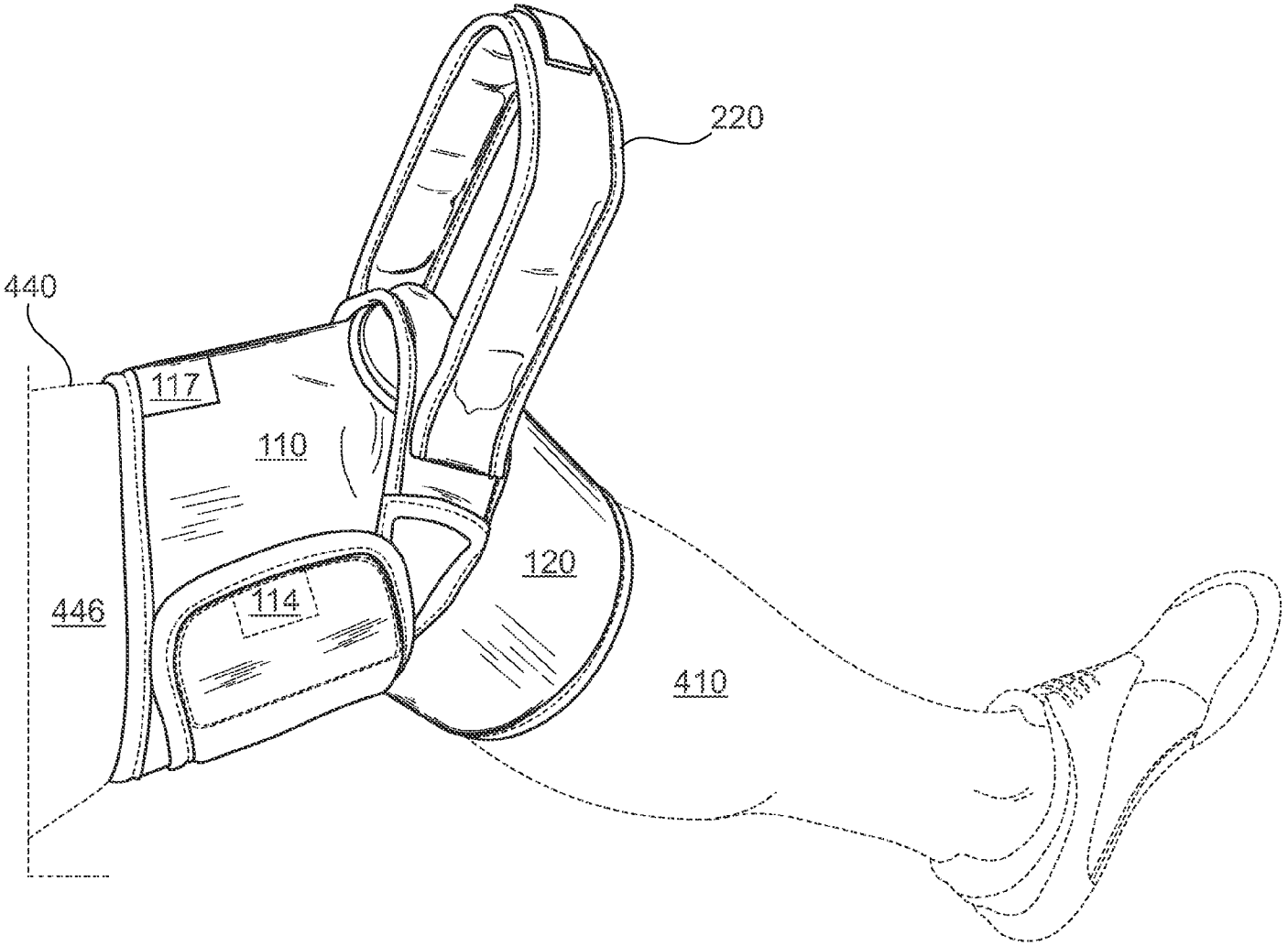
FIG. 9 is a perspective view of a disclosed piri-stretcher in a deployed position upon a leg.

FIG. 9 depicts a piri-stretcher in a deployed position with the thigh strap 110 secured around a thigh 446 and the calf strap 120 secured around a calf 410. Placement markings 117 are found upon the thigh strap. The upper handle 220 is shown in an upright position, ready to be grasped.

Figure 10:
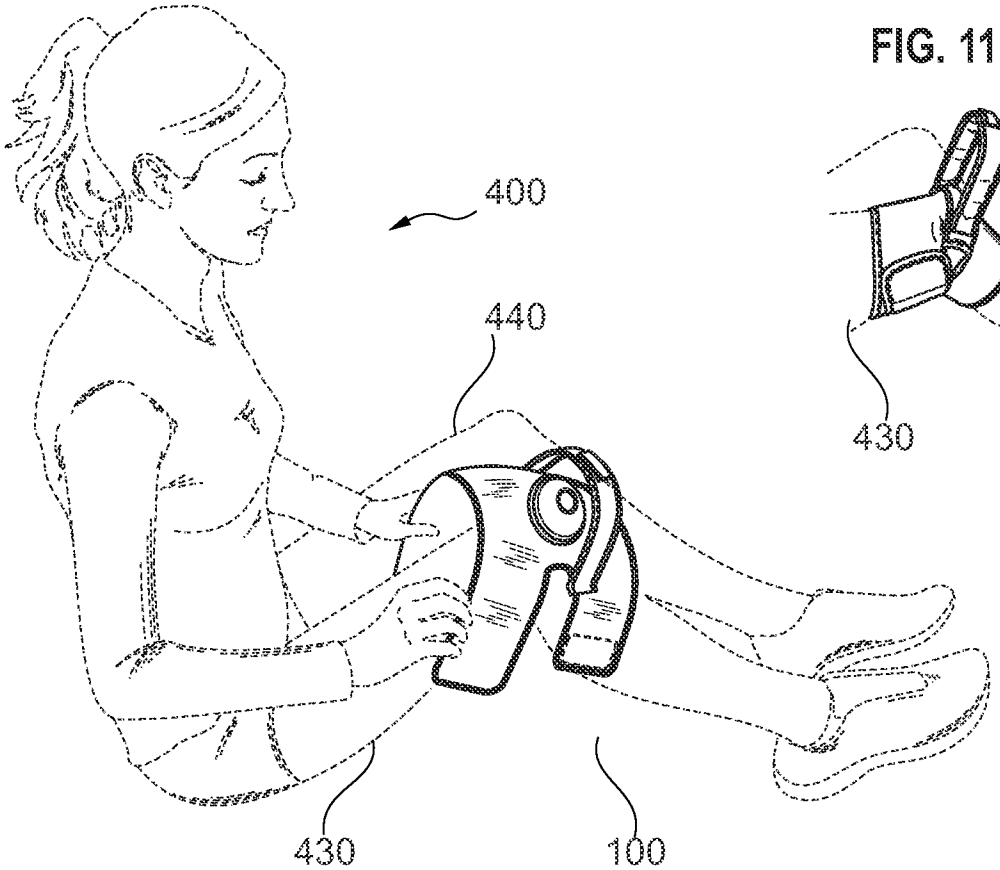
FIG. 10 is a perspective view of a disclosed piri-stretcher in an unfolded position upon a leg.

FIG. 10 depicts a human 400 with a piri-stretcher 100 draped over her right leg 430. The left leg 440 is shown as free to cross over for stretching purposes.

Figure 11:
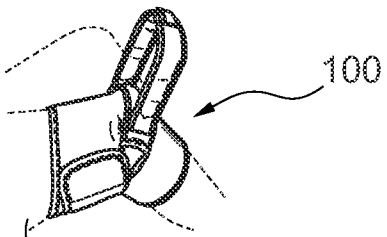
FIG. 11 is a perspective view of a disclosed piri-stretcher in a deployed position upon a leg.

FIG. 11 depicts a piri-stretcher 100 is a deployed position upon a right leg 430.

Figure 12:
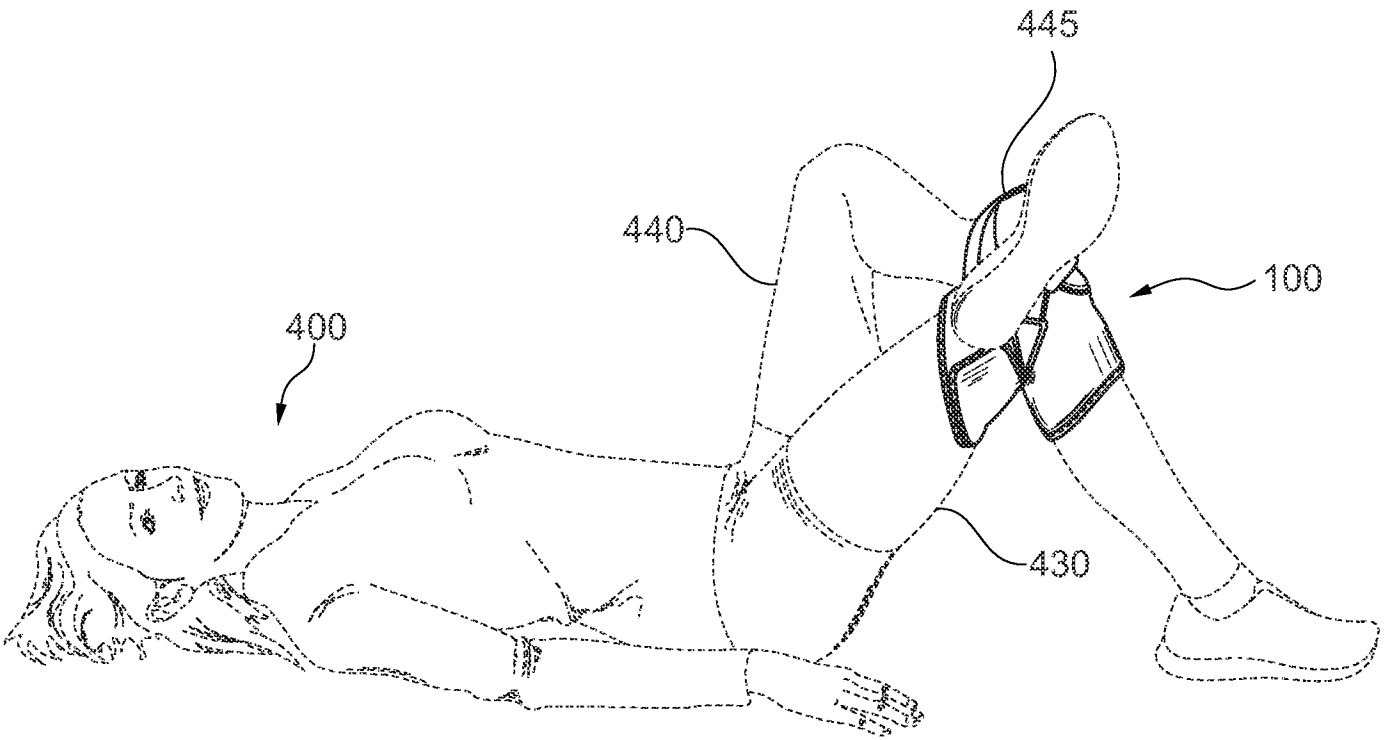
FIG. 12 is a perspective view of a disclosed piri-stretcher in a deployed position upon the right leg of a human, with the human's left angle placed upon the piri-stretcher.

FIG. 12 depicts a human 400 with her back upon the ground and with her left leg 440 crossed over, with the ankle area 445 placed upon a piri-stretcher 100, with her right leg 430 secured to the piri-stretcher.

Figures 13, 14:
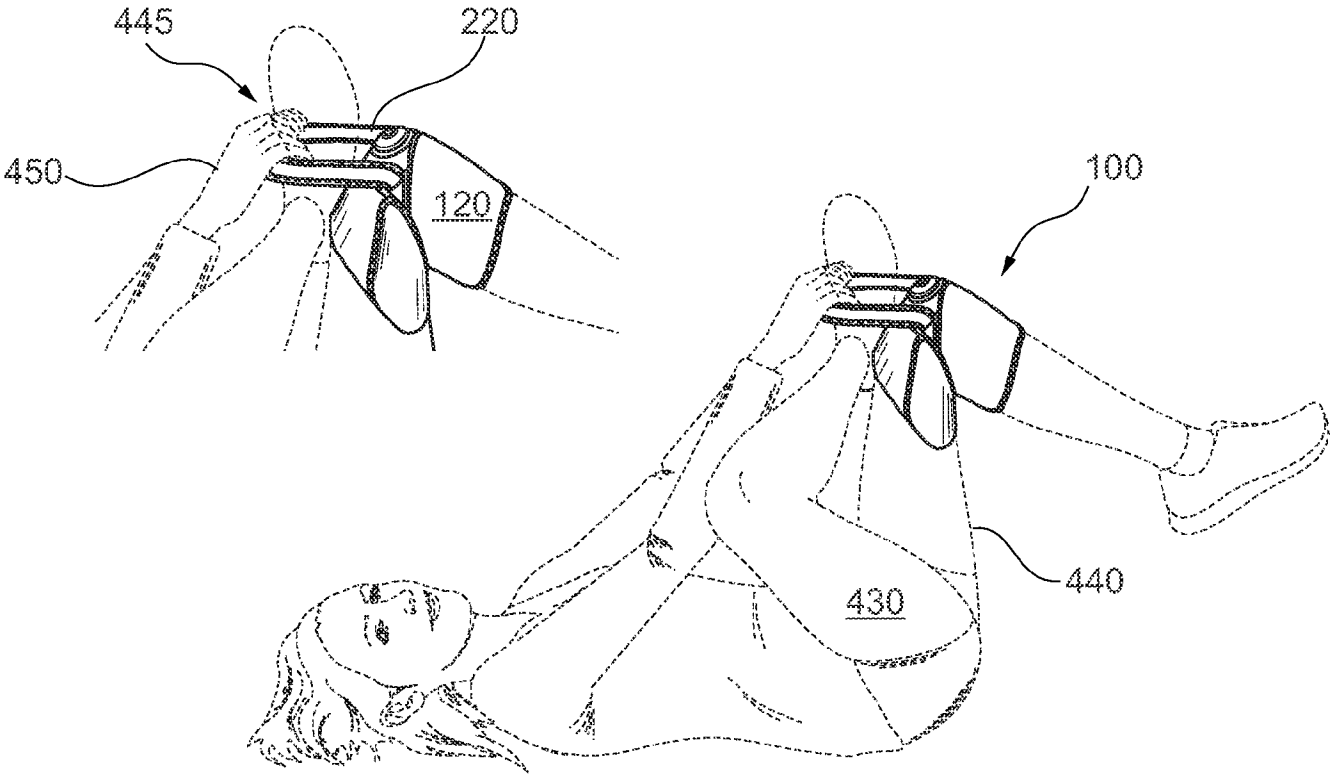
FIG. 13 is a perspective view of disclosed piri-stretcher in a deployed position upon the left leg of a human, with the human's right angle placed upon the piri-stretcher.
FIG. 14 is an expanded view of FIG. 13 showing a disclosed piri-stretcher.

FIG. 13 depicts a piri-stretcher 100 deployed upon a left leg 440 with a right leg 430 crossed over such that the ankle of the right leg is resting upon the piri-stretcher. FIG. 14 depicts the human's hands 450 grasping the upper handle 220 with the ankle area 445 of the right leg placed upon the thigh strap.

Figure 15:
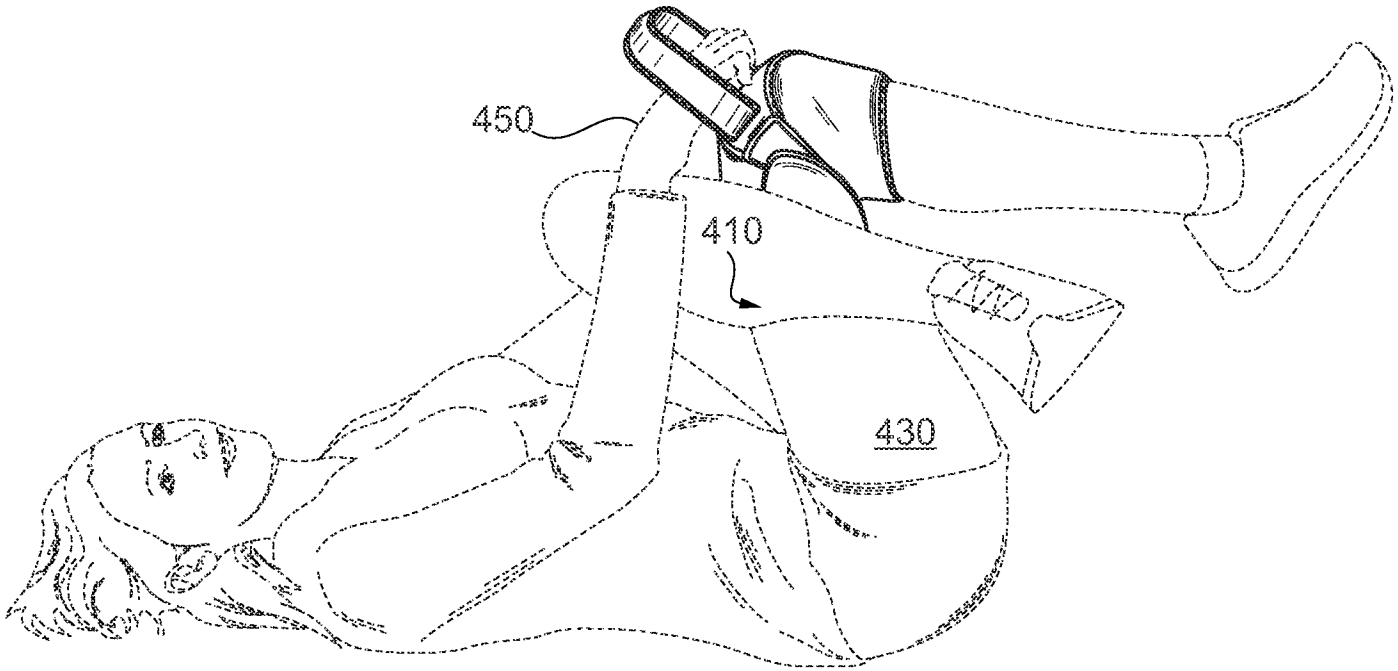
FIG. 15 is a perspective view of disclosed piri-stretcher in a deployed position upon the right leg of a human, with the human's left calf placed upon the piri-stretcher.

FIG. 15 depicts an alternative piriformis muscle stretch position wherein the lower strap is grasped with the human's hands 450 and the calf area or knee area of the unsecured leg rests upon the thigh strap, the thigh strap secured to the opposite leg.

Figure 16:
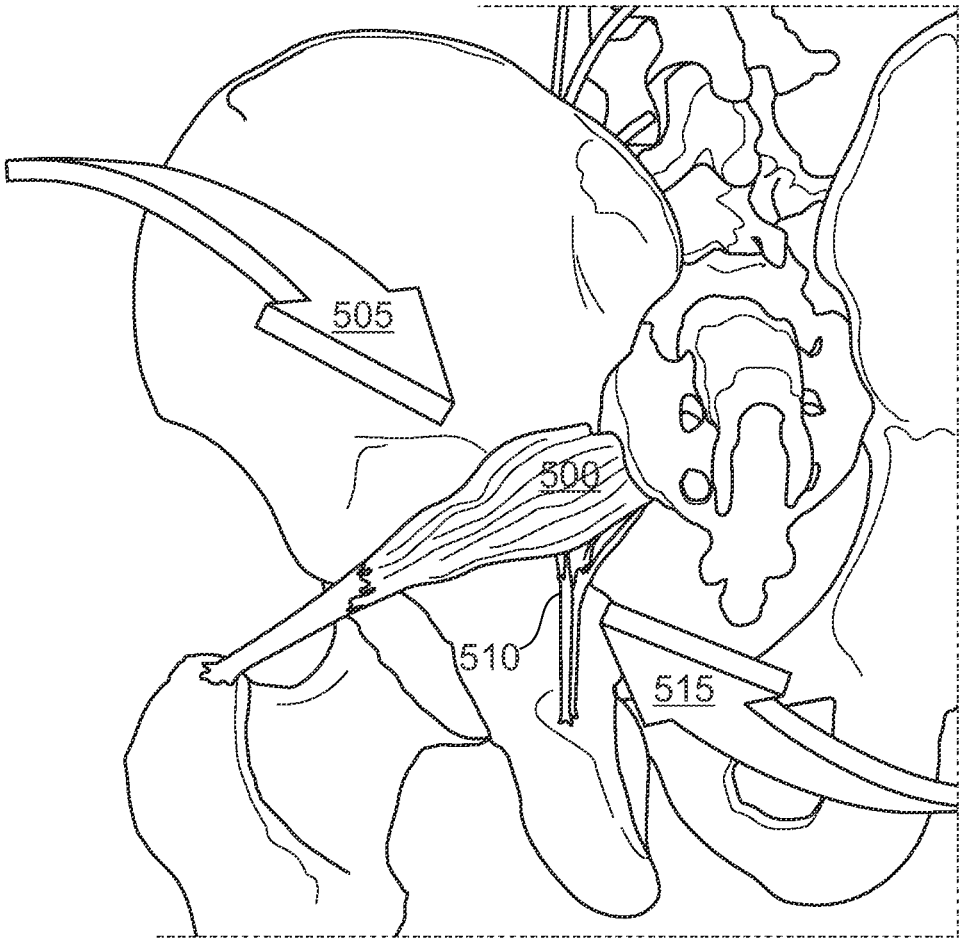
FIG. 16 is a perspective view of a human skeleton, showing a piriformis muscle and a sciatic nerve.

FIG. 16 depicts a human skeleton having a piriformis muscle 500 adjacent to a sciatic nerve 510. An upper directional arrow 505 points to the piriformis muscle 500 while a lower directional arrow 515 points to the sciatic nerve.

Figure 17:
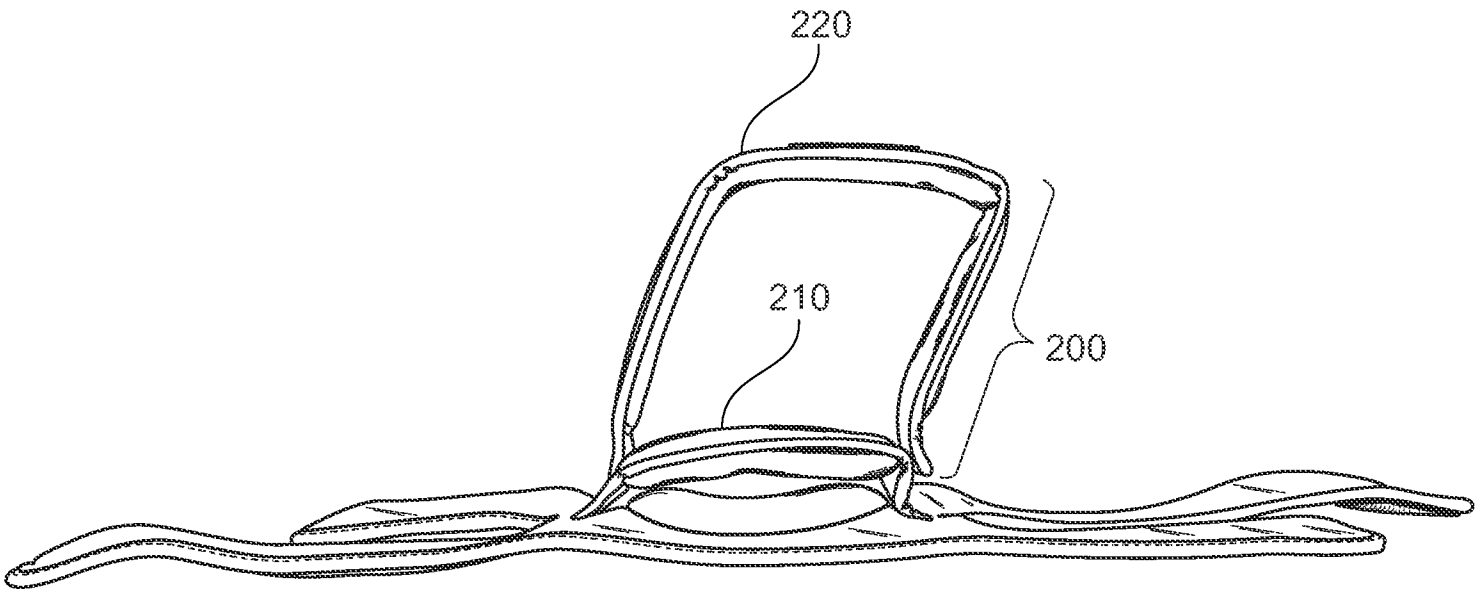
FIG. 17 is a side perspective view of a disclosed piri-stretcher.

FIG. 17 depicts a handle assembly 200 comprising a lower handle 210 and an attached upper handle 220.

Figure 18:
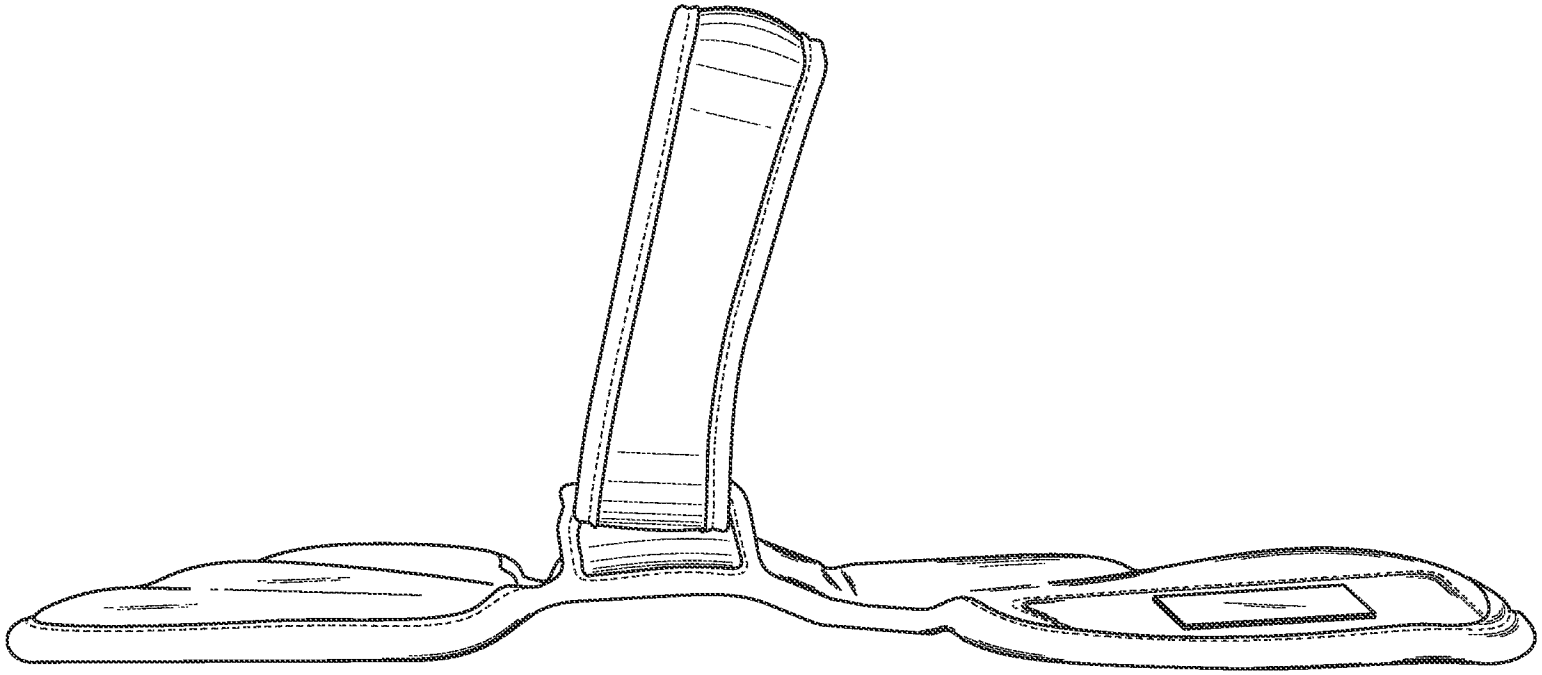
FIG. 18 is a front perspective view of a disclosed piri-stretcher.

FIG. 18 depicts a depicts a piri-stretcher in a relaxed position.

Figure 19:
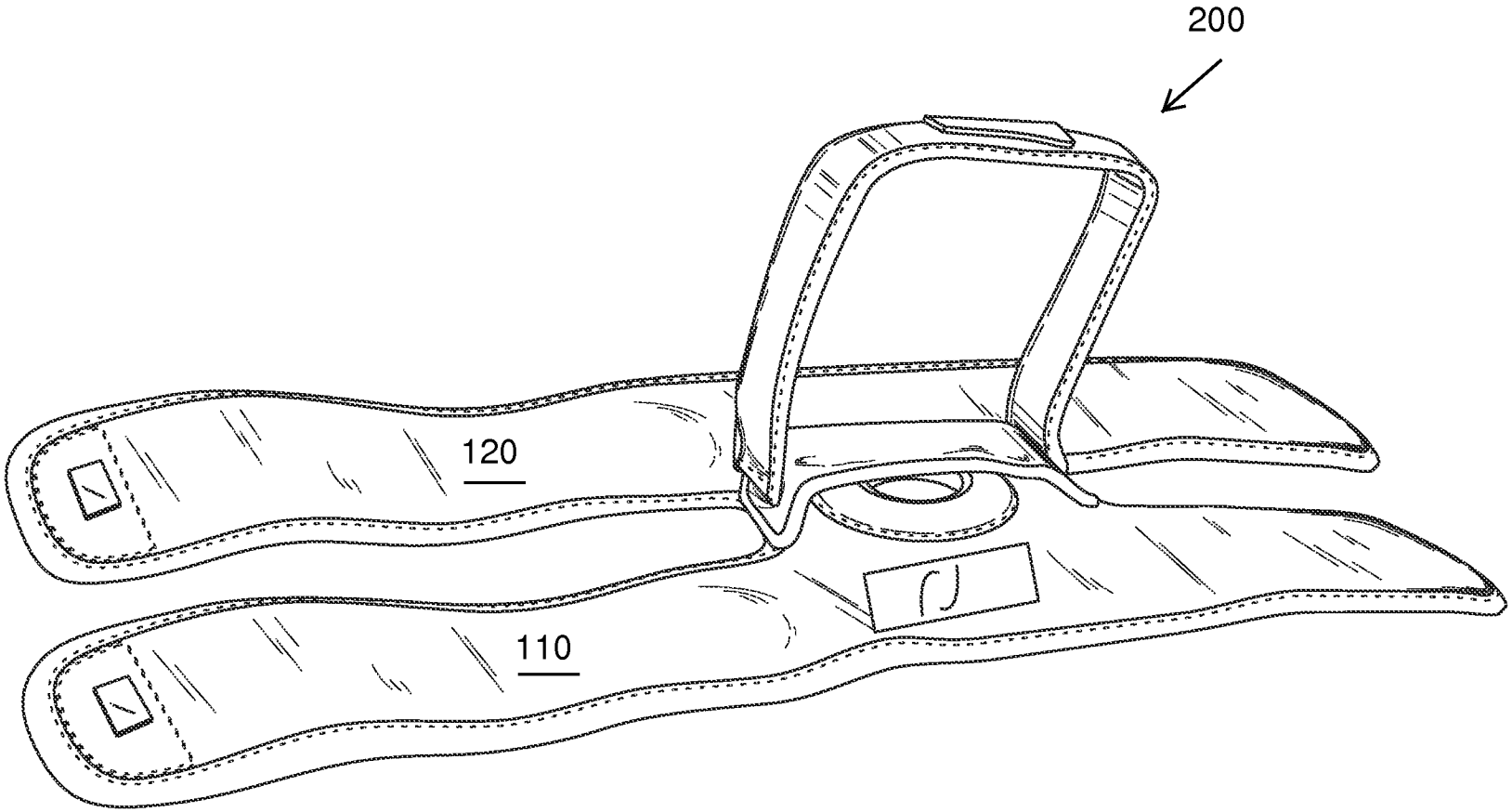
FIG. 19 depicts a perspective view of a disclosed piri-stretcher system with calf and thigh straps of equal or near equal length.

FIG. 19 depicts a calf strap 120 of equal or near equal length to a thigh strap 110. A handle assembly 200 may comprise one or more handles or straps and may be positioned anywhere upon the piri-stretcher system.

Figure 20:
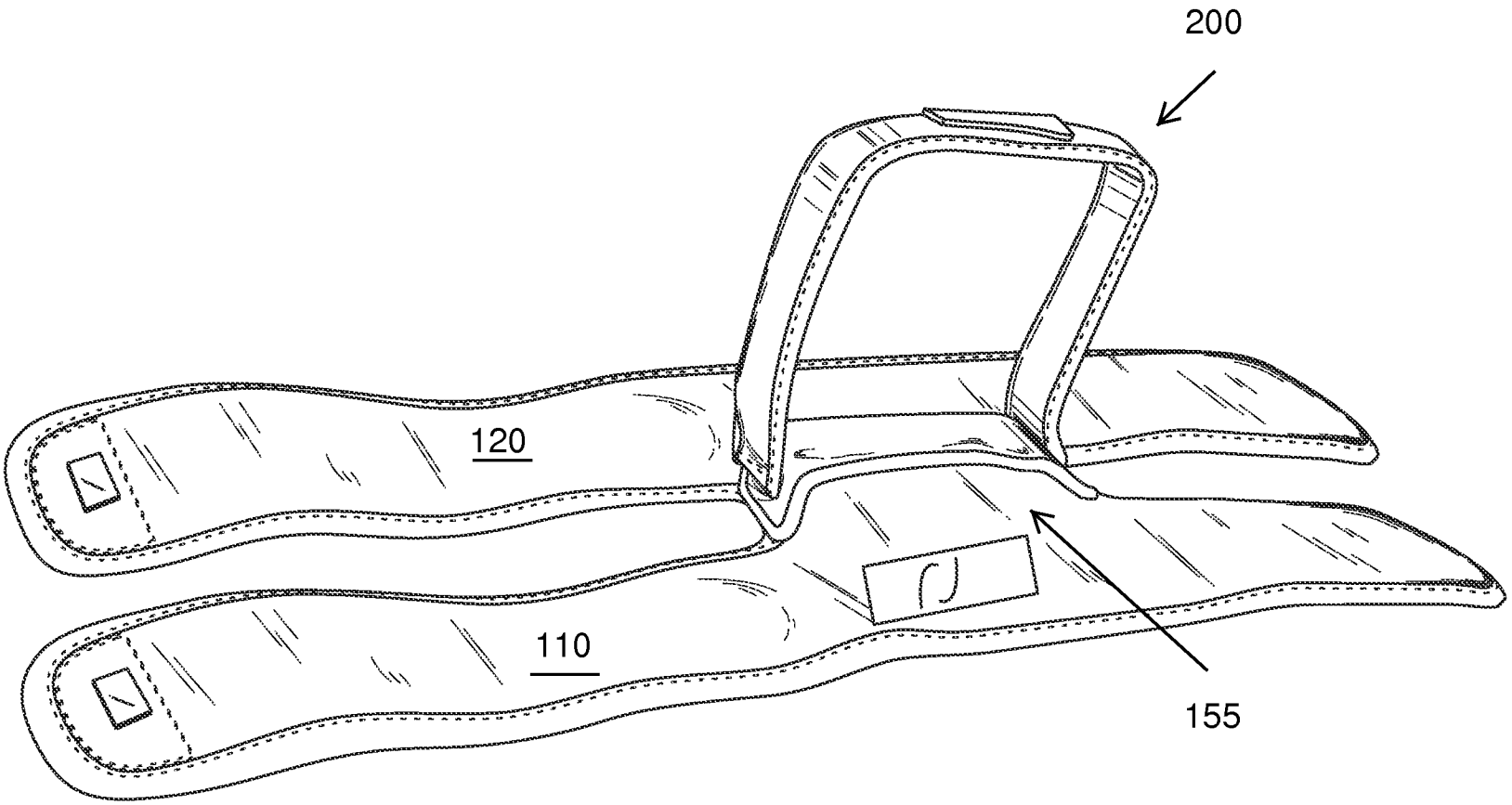
FIG. 20 depicts a perspective view of a disclosed piri-stretcher system with no center void or knee hole.

FIG. 20 FIG. 19 depicts a calf strap 120 of equal or near equal length to a thigh strap 110. A piri-stretcher system may comprise unperforated material under the handle assembly 200. A piri-stretcher system may be devoid of a knee void. Disclosed embodiments include the use of a monolithic piece of fabric or material used to create or define a calf strap and a thigh strap with center zone 155 between the calf strap and thigh strap.

Figure 21:
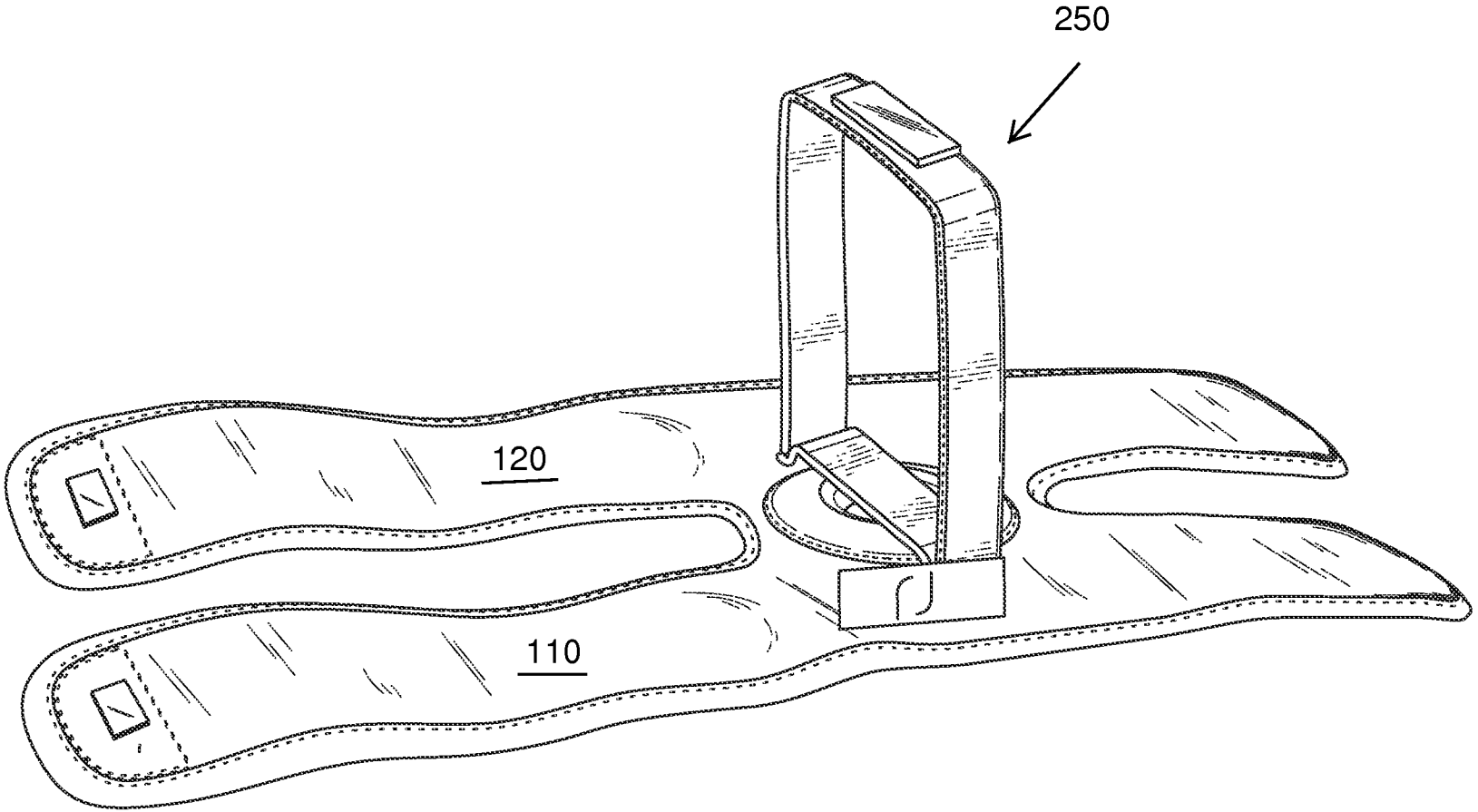
FIG. 21 depicts a perspective view of a disclosed piri-stretcher system with one or more handles normal or perpendicular to the thigh and calf straps

FIG. 21 depicts a handle assembly 250 perpendicular or normal to the calf strap 120 and the thigh strap 110. Such a handle assembly may comprise one or more handles or pull straps.

Figure 22:
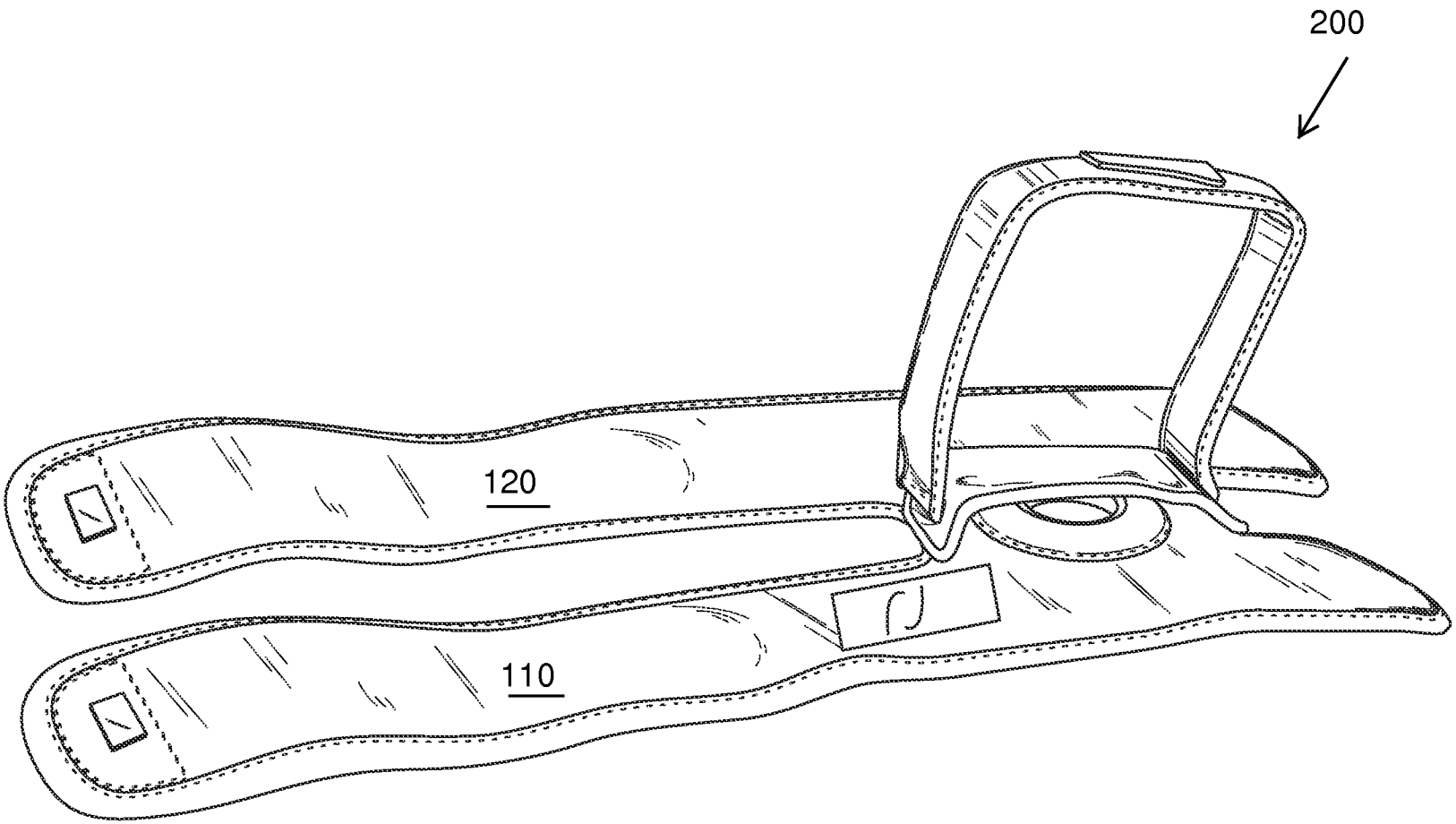
FIG. 22 depicts a perspective view of a disclosed piri-stretcher system with a strap or center assembly in an uncentered position.

FIG. 22 depicts a handle assembly or a grouping of one or more handles or straps positioned near the end points of a calf strap 120 and a thigh strap 110.

Figure 23:
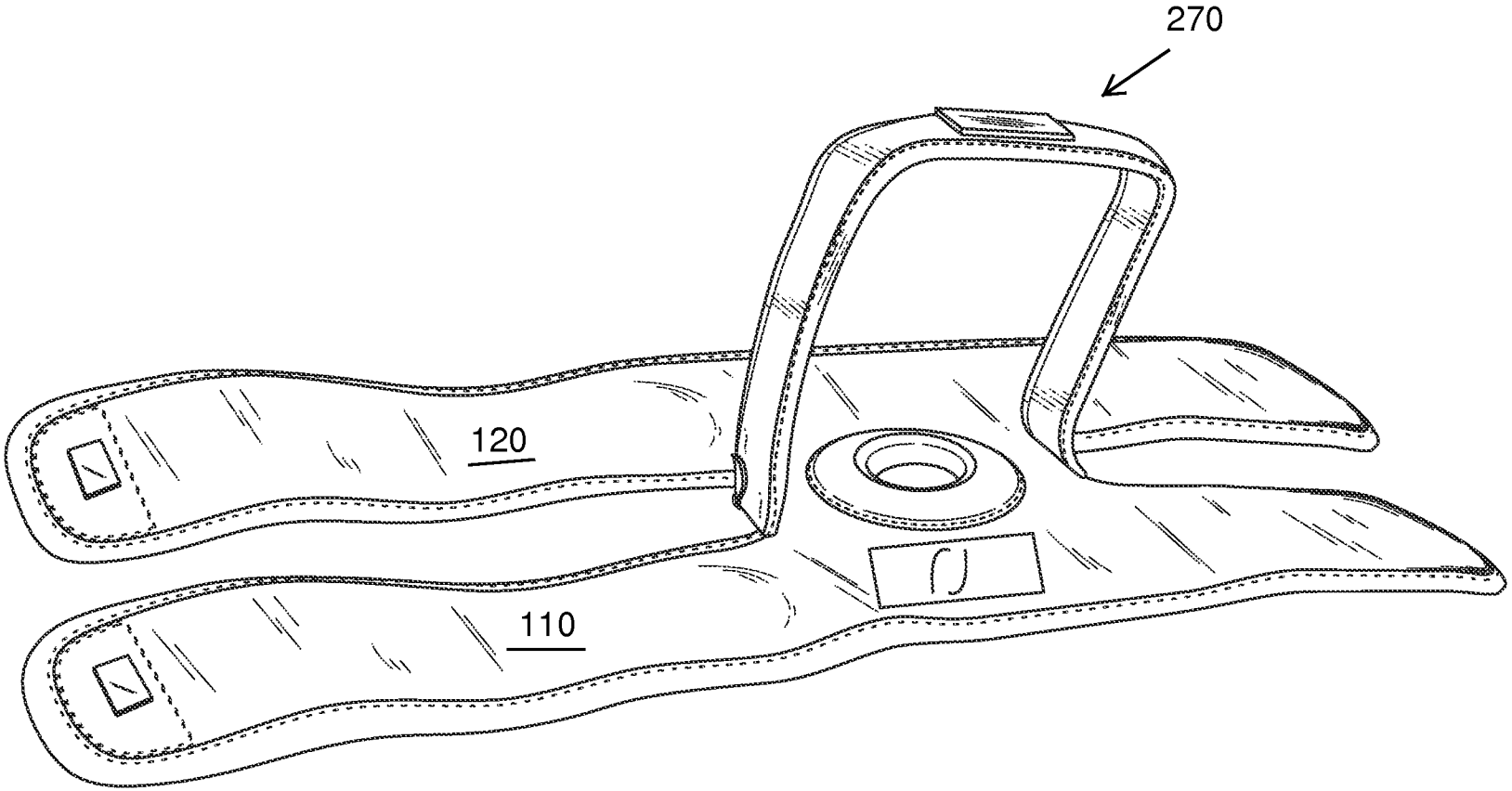
FIG. 23 depicts a perspective view of a disclosed piri-stretcher system with one pull strap attached to a center major position.

FIG. 23 depicts a handle assembly 270 comprising a single handle or pull strap.

Figure 24:
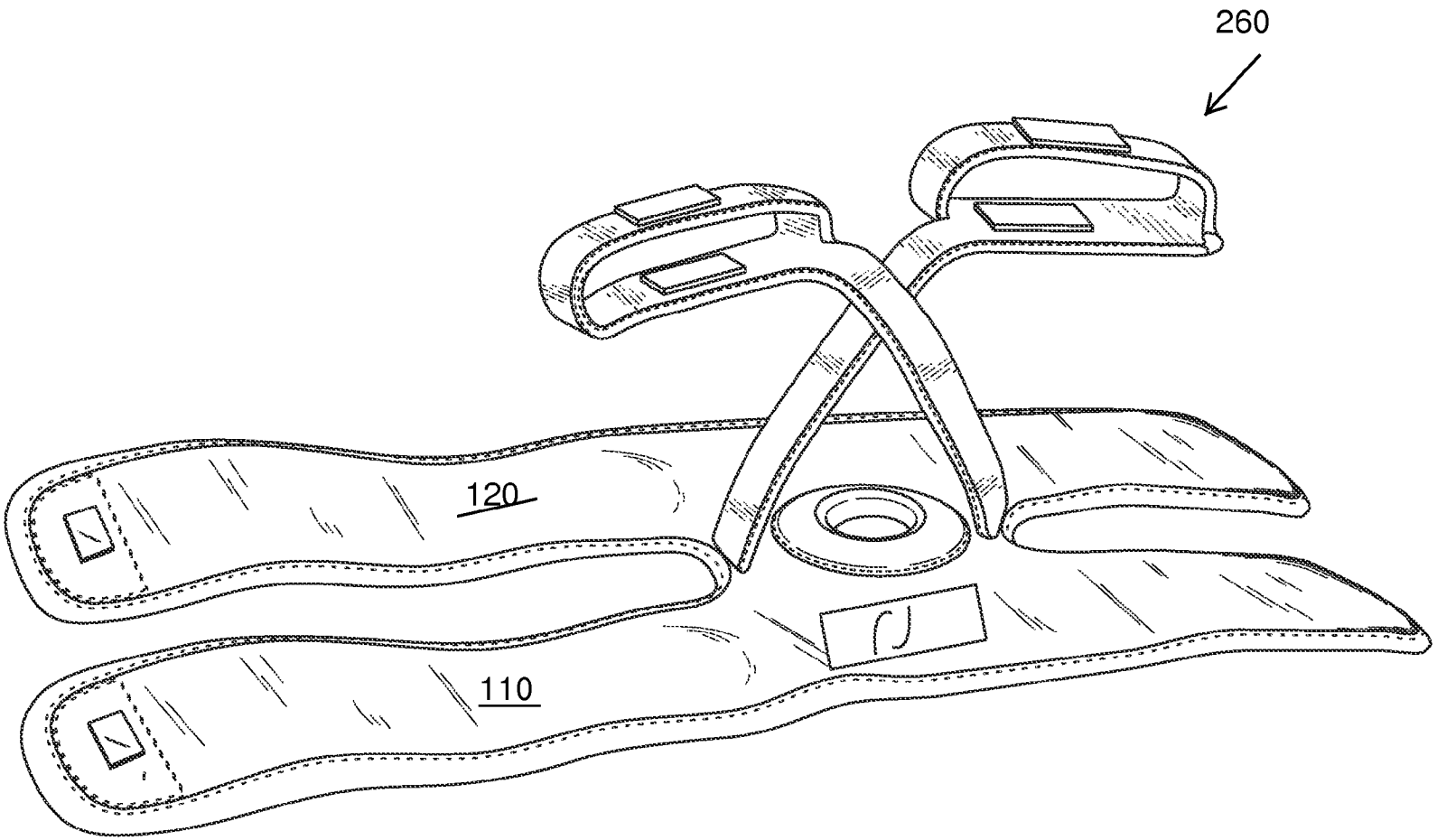
FIG. 24 depicts a perspective view of a disclosed piri-stretcher system with two separate handles.

FIG. 24 depicts a handle assembly 260 comprising one or more handles secured by one strap.

Figure 25:
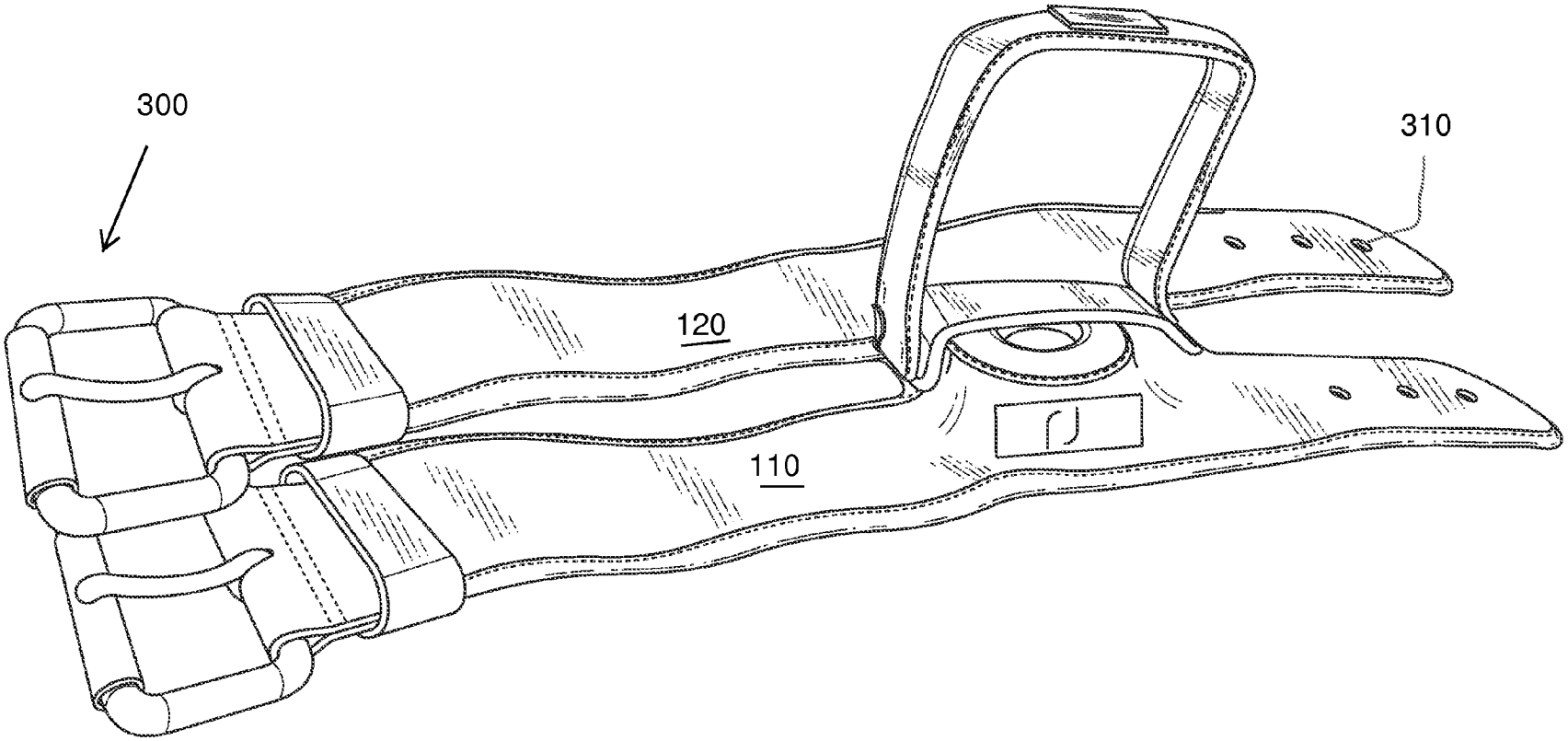
FIG. 25 depicts a perspective view of a disclosed piri-stretcher system with adjustable buckles attached to the ends of a thigh strap and calf strap.

FIG. 25 depicts a disclosed embodiment with a buckle system 300 found upon a first end of a calf strap 120 and a first end of a thigh strap 110 with buckle voids defined within a second end of a calf strap and a second end of a thigh strap.

In one embodiment, a piri-stretcher in a normal size may have a thigh strap of 21 to 27 inches and a calf strap of 17 to 22 inches. Material may comprise 3 mm neoprene and one handle may be supplied.

Disclosed embodiments include a one or two handle system with a thigh strap of 23 to 29 inches, a calf strap of 19 to 24 inches. Material may comprise 1 to 15 mm neoprene.

A calf strap and a thigh strap may comprise a longitudinal section running lengthwise. Each end of a calf strap and thigh strap may have means of attachment to its respective opposite end. Such means include the use of fasteners such as Velcro, buckles, buttons, snaps and all other fastener systems.

Disclosed embodiments may include the following items.

Item 1. A system for stretching a piriformis muscle, the system comprising:

a thigh strap 110 comprising a major section 116 attached to a minor section 115, the thigh strap 110 having an upper side 111 and a lower side 112;

a center assembly 150 attached to the thigh strap, the center assembly comprising center material 160, a circular collar 170 attached to the center material 160, the circular collar further defined by an outer perimeter 173 and an inner perimeter 175;

a knee cap void 180 defined by the inner perimeter 175 of the circular collar 170;

a calf strap 120, attached to the center material 160, the calf strap 120 comprising a major section 126 and a minor section 125, the calf strap 120 having an upper surface 121 and a lower surface 122; and a lower handle 210 attached to the center material.

Item 2. The system of item 1 further comprising an upper handle 220 attached to the lower handle 210.

Item 3. The system of item 1 further comprising a thigh hook section 113 attached to the thigh strap 110 and a calf hook section attached to the calf strap 120.

Item 4. The system of item 3 further comprising the thigh hook section 113 attached to the bottom surface 112 of the thigh strap 110 and further comprising the calf hook section 123 attached to the bottom surface 122 of the calf strap 120.

Item 5. The system of item 3 wherein the major section 116 of the thigh strap 120 is adjacent to the minor section 125 of the calf strap 120.

Item 6. The system of item 5 wherein the top surface of the thigh strap and top surface of the calf strap are comprised of loop material capable of attachment to the thigh hook section 113 and calf hook section 123.

Item 7. The system of item 1 wherein the upper surface 112 of the thigh strap 110 further comprises placement markings 117 indicating the placement of an ankle upon the thigh strap 110.

Item 8. A method of stretching a piriformis muscle using the system of item 1, the method comprising the steps of:

attaching the thigh strap around the thigh of a first leg;

attaching the calf strap around the calf of the first leg;

bending the knee of the first leg;

placing an ankle of the second leg upon the thigh strap; and grasping the lower handle and pulling the lower handle.

Item 9. A kit for stretching the piriformis muscle, the kit comprising:

a thigh strap 110 comprising a major section 116, a minor section 115, an upper surface and a lower surface;

a center assembly 150 comprising center material 160 attached to a circular collar 170, the circular collar comprised of an outer perimeter 173 and an inner perimeter 175;

a knee cap void 180 defined by the inner perimeter 175 of the circular collar 170;

a calf strap 120 comprising a major section 126 and a minor section 125, calf strap having an upper surface 122 and a lower surface; and a lower handle.

Item 10. The kit of item 9 further comprising a second handle.

Item 11. A system for stretching a piriformis muscle, the system comprising:

a) a thigh strap comprising a major section attached to a minor section, the thigh strap having an upper surface and a lower surface;

b) a center assembly attached to the thigh strap, the center assembly comprising center material, a circular collar attached to the center material, the circular collar further defined by an outer perimeter and an inner perimeter;

c) a knee cap void defined by the inner perimeter of the circular collar;

d) a calf strap, attached to the center material, the calf strap comprising a major section and a minor section, the calf strap having an upper surface and a lower surface; and e) a lower handle comprising a first end and a second end, with the first end attached between the minor section of the calf strap and the major section of the thigh strap and the second end of the lower handle attached between the major section of the calf strap and the minor section of the thigh strap;

f) an upper handle with a first end attached upon the lower handle and a second end attached upon the lower handle.

Item 12. The system of 11 further comprising a thigh hook section attached to the thigh strap and a calf hook section attached to the calf strap.

Item 13. The system of 12 further comprising the thigh hook section attached to the lower surface of the thigh strap and further comprising the calf hook section attached to the lower surface of the calf strap.

Item 14. The system of 13 wherein the major section of the thigh strap is adjacent to the minor section of the calf strap.

Item 15. The system of 14 wherein the upper surface of the thigh strap and upper surface of the calf strap are comprised of loop material capable of attachment to the thigh hook section and calf hook section.

Item 16. The system of 15 wherein the upper surface of the thigh strap further comprises placement markings indicating the placement of an ankle upon the thigh strap.

Item 17. A kit for stretching the piriformis muscle, the kit comprising:

a thigh strap comprising a major section, a minor section, an upper surface and a lower surface;

a center assembly comprising center material attached to a circular collar, the circular collar comprised of an outer perimeter and an inner perimeter;

a knee cap void defined by the inner perimeter of the circular collar;

a calf strap comprising a major section and a minor section, calf strap having an upper surface and a lower surface; and a lower handle comprising a first end and a second end, with the first end attached between the minor section of the calf strap and the major section of the thigh strap and the second end of the lower handle attached between the major section of the calf strap and the minor section of the thigh strap;

an upper handle with a first end attached to the lower handle and the upper handle having a second end attached to the lower handle.

Item 18. A system for stretching a piriformis muscle, the system comprising:

a) a thigh strap comprising a longitudinal section, the thigh strap having an upper surface and a lower surface;

b) a portion of center material connected to the thigh strap;

d) a calf strap, attached to the center material, the calf strap comprising a longitudinal section, an upper surface and a lower surface; and e) a handle attached to the center material.

Item 19. The system of 18 wherein the center material defines a void;

Item 20. The system of 19 wherein the void if further defined by a circular collar.

Item 21. The system 20 wherein the center material is attached to a lower handle and an upper handle.

These and other changes can be made to the invention in light of the above detailed description. In general, the terms used in the following claims, should not be construed to limit the invention to the specific embodiments disclosed in the specification, unless the above detailed description explicitly defines such terms. Accordingly, the actual scope of the invention encompasses the disclosed embodiments and all equivalent ways of practicing or implementing the invention under the claims.

While certain aspects of the invention are presented below in certain claim forms, the inventors contemplate the various aspects of the invention in any number of claim forms.

What is claimed is:

1. A system for stretching a piriformis muscle, the system comprising:

a) a thigh strap comprising a longitudinal section, the thigh strap having an upper surface, a lower surface, a first end and a second end with the first end having means of attachment to the second end;

b) a center material attached to the thigh strap and a calf strap;

c) a circular collar attached to the center material, the circular collar further defined by an outer perimeter and an inner perimeter;

d) a knee cap void defined by the inner perimeter of the circular collar;

e) the calf strap comprising a longitudinal section, an upper surface, a lower surface, a first end and a second end with the first end having means of attachment to the second end; and f) a handle with a first end and a second end coupled to a respective end of the center material with a surface of the handle extending away from a surface of the center material to define a space between the center material and the surface of the handle, the space being sized and configured to be received by a hand of a user so that the user may pull on the handle to stretch the piriformis muscle.

2. The system of claim 1 wherein the longitudinal section of the thigh strap comprises a major section and a minor section; the longitudinal section of the calf strap comprises a major section and a minor section, the first end and the second end of the handle are further disposed between the calf strap and the thigh strap.

3. A kit for stretching a piriformis muscle, the kit comprising:

a) a thigh strap comprising a major section attached to a minor section, the thigh strap having an upper surface, a lower surface, a first end and a second end with the first end having means of attachment to the second end;

b) a center material attached to the thigh strap;

c) a circular collar attached to the center material, the circular collar further defined by an outer perimeter and an inner perimeter;

d) a knee cap void defined by the inner perimeter of the circular collar;

e) a calf strap, attached to the center material, the calf strap comprising a major section attached to a minor section, an upper surface, a lower surface, the major section having means of attachment to the minor section;

f) the center material having a width defined between the first and the second ends of both the thigh strap and the calf strap; and g) a handle with a first end and a second end coupled to a respective end of the center section with a surface of the handle extending away from a surface of the center section to define a space between the center material and the surface of the handle, the space being sized and configured to be received by a hand of a user so that the user may pull on the handle to stretch the piriformis muscle.

4. A kit for stretching a piriformis muscle, the kit comprising:

a) a thigh strap comprising a major section attached to a minor section, the thigh strap having an upper surface, a lower surface, a first end and a second end with the first end having means of attachment to the second end;

b) a center material attached to the thigh strap;

c) a calf strap, attached to the center material, the calf strap comprising a major section attached to a minor section, an upper surface, a lower surface, the major section having means of attachment to the minor section;

d) the center material having a width defined between the first and the second ends of both the thigh strap and the calf strap;

e) a lower handle comprising a first end and a second end coupled to a respective end of the center material, the lower handle having a surface extending away from a surface of the center section to define an space that is sized and configured to be received by a hand of a user; and f) an upper handle with a first end and second end attached upon the lower handle, the upper handle having a surface extending away from another surface of the lower handle to define a second space that is sized and configured to be received by a hand of a user, wherein the user may pull on either the lower handle or the upper handle to stretch the piriformis muscle.

* * * * *